US010900159B2

(12) United States Patent
Lindsay

(10) Patent No.: US 10,900,159 B2
(45) Date of Patent: Jan. 26, 2021

(54) BATTING BIN

(71) Applicant: Debra W Lindsay, Mountain Home, UT (US)

(72) Inventor: Debra W Lindsay, Mountain Home, UT (US)

( * ) Notice: Subject to any disclaimer, the term of this patent is extended or adjusted under 35 U.S.C. 154(b) by 0 days.

(21) Appl. No.: 15/853,781

(22) Filed: Dec. 23, 2017

(65) Prior Publication Data

US 2019/0194848 A1 Jun. 27, 2019

(51) Int. Cl.
*D05B 11/00* (2006.01)
*D05B 35/00* (2006.01)

(52) U.S. Cl.
CPC ..... *D05B 35/00* (2013.01); *D05B 11/00* (2013.01)

(58) Field of Classification Search
CPC ..... D05B 11/00; D05B 39/00; D05B 41/00; D05B 35/00
See application file for complete search history.

(56) References Cited

U.S. PATENT DOCUMENTS 413,811 A * 10/1889 Palmer ..... A47G 9/0207
1,069,212 A * 8/1913 Wilcox ..... D05B 75/02 112/217.1
3,045,742 A * 7/1962 Brooks ..... B32B 27/00 156/202
3,246,616 A * 4/1966 Korioth, III ..... D05B 33/02 112/217
5,603,270 A * 2/1997 White ..... D05B 11/00 112/117
9,598,804 B1 * 3/2017 Fishburn ..... D05B 11/00

* cited by examiner

*Primary Examiner* — Tajash D Patel
(74) *Attorney, Agent, or Firm* — Malone IP Law; Steven J. Malone

(57) ABSTRACT

A long arm quilting machine with a batting bin has been developed. The batting bin includes an elongated partially enclosed trough that attaches to the quilting machine and extends, in length, more than 50% of a longest dimension of the quilting machine. The batting bin includes one or more support members to support a position of the trough in relation to the quilting machine. The trough has an open upper portion which allows batting material to be dispensed upward into the quilting machine. The trough has an enclosed lower portion such that batting material within the trough is kept from touching a floor the quilting machine is positioned over.

16 Claims, 4 Drawing Sheets

BATTING BIN

BACKGROUND

Field of the Invention

The present invention relates long arm quilting machines and accessories of long arm quilting machines.

SUMMARY

A long arm quilting machine with a batting bin has been developed. The batting bin includes an elongated partially enclosed trough that attaches to the quilting machine and extends, in length, more than 50% of a longest dimension of the quilting machine. The batting bin includes one or more support members to support a position of the trough in relation to the quilting machine. The trough has an open upper portion which allows batting material to be dispensed upward into the quilting machine. The trough has an enclosed lower portion such that batting material within the trough is kept from touching a floor the quilting machine is positioned over.

A quilting machine batting bin may include two or more support members. A quilting machine batting bin may be formed from sheet metal, fiber glass, wire, wire mesh, plastic, screen material, perforated material, wood, paper, or a combination thereof. A quilting machine batting bin trough may have a length of between 5 feet and 15 feet. A quilting machine batting bin trough may have a width of between 6 inches and 18 inches. A quilting machine batting bin trough may have a height of between 4 inches and 18 inches. A quilting machine batting bin may attach to the quilting machine using screws, hinges, bolts, glue, hooks, or welds. A quilting machine batting bin front side may be positioned lower than a rear side of the batting bin forming an angled trough. A quilting machine batting bin lower trough portion may be semi-circular is shape. A quilting machine batting bin lower trough portion may be rectangular or square in shape. A quilting machine batting bin may further include end caps which enclose the lower portion of the trough. Quilting machine batting bin end caps may provide structural support for the batting bin by attaching to the quilting machine. The quilting machine batting bin may further include a first material roller positioned above the batting bin. A quilting machine batting bin may further include a second material roller positioned above the batting bin. A quilting machine batting bin may further include two or more through holes in the rear side of the batting bin for attaching the batting bin to the quilting machine. A quilting machine batting bin may include an angled trough allowing a user to easily access the quilting machine and batting material during operation of the quilting machine. The quilting machine may further include an automated sewing function. The quilting machine automated sewing function may sew the batting material between two sheets of material. The quilting machine sheets of material may be located on rollers above the batting bin. The quilting machine batting bin may keep debris off of the batting material while the batting material is sewn between the two sheets of material.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings.

Figure 1:
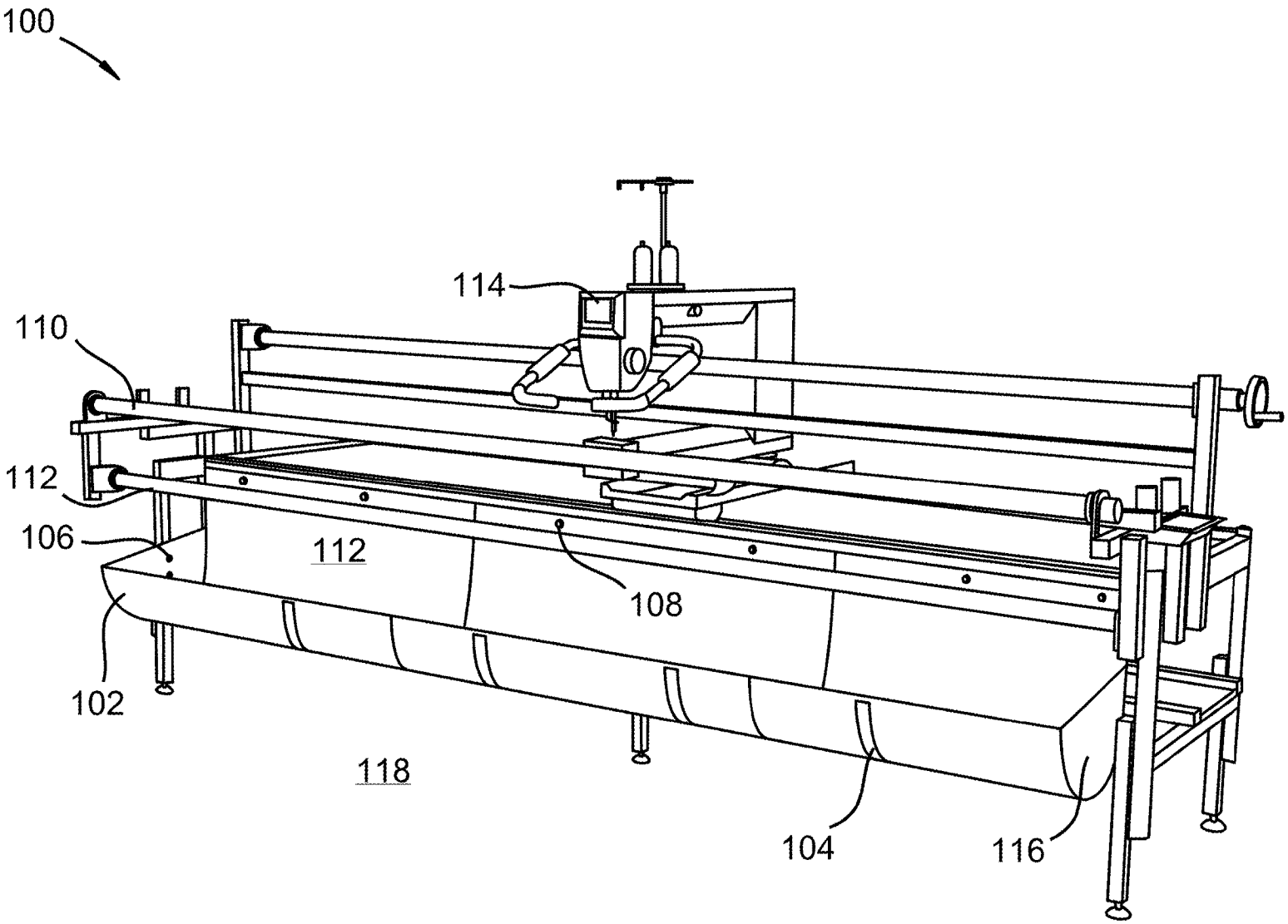
FIG. 1 depicts a long arm quilting machine in accordance with an embodiment of the invention.

FIG. 1 shows a long arm quilting machine 100 in accordance with an embodiment of the invention. Long arm quilting machine 100 includes material rollers 110, 112 which provide top and bottom layers of a quilt. Batting bin 112 holds batting material that is sewn between material sheets provided by material rollers 110, 112. Batting bin 112 keeps the batting material off of floor 118 while long arm quilting machine 100 stitches a quilt together. Automated stitcher 114 may be loaded with a program that automates the stitching of quilts. Batting bin 112 may be held in place by mechanical fasteners 106, 108. Mechanical fasteners may be screws, bolts, nuts, hooks, or track devices. Additionally or alternatively, glue or welding may be used to secure batting bin 112 to long arm quilting machine 100. Batting bin 112 may be as long as a longest dimension of quilting machine 100 or at least as long as 50% of the longest dimension of quilting machine 100. A length of batting bin 112 may be defined by a distance from end 102 to end 116. Batting bin 112 has a longer rear side shown connecting to quilting machine 100 at fastener 108. Fastener 108 may be a through hole device going through a through hole in the rear side of batting bin trough 112. A shorter batting bin trough font side is also pointed to by pointer 102. End cap portions 106 and 116 may be fastened to a frame member of quilting machine 100. This is shown at pointer 116. Support members 104 may be used to support batting bin trough 112. Support members 104 may be made of metal, plastic, fiber glass, wood, or composite materials. Support members 104 may be injection molded members or may be part of an integrally formed batting bin. Batting bin 112 may be formed from sheet metal, fiber glass, wire, wire mesh, plastic, screen material, perforated material, composite materials, wood, paper, or a combination thereof. Batting bin 112 may be made of component pieces or may be in-part or wholly formed as an injection molded bin.

Figure 2:
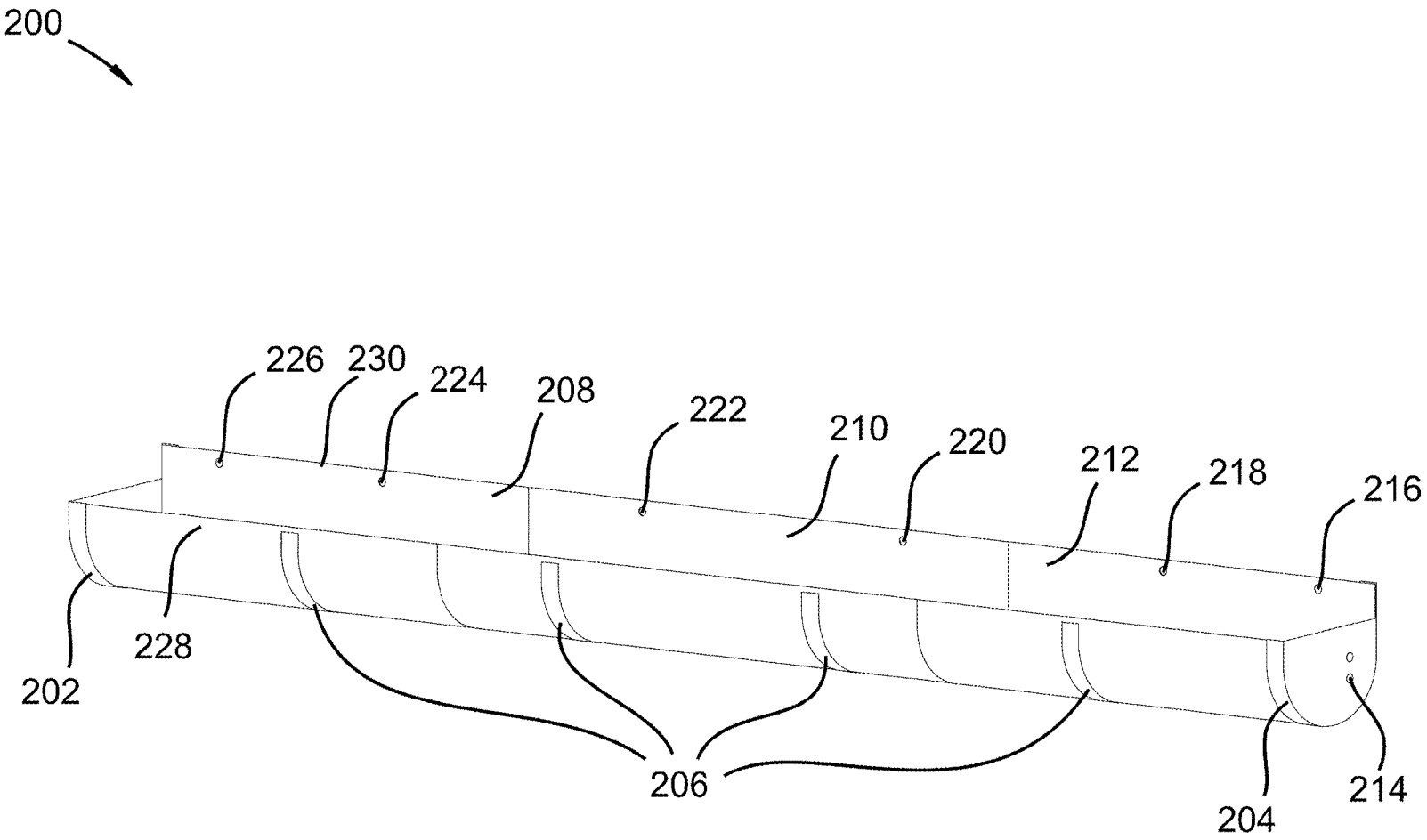
FIG. 2 depicts a batting bin in accordance with an embodiment of the invention.

FIG. 2 shows a batting bin 200 in accordance with an embodiment of the invention. Batting bin 200 includes mounting holes 214-226, support members 206, end caps 202 and 204, and component sections 208, 210, and 212. Mounting holes 216-226 may overlap mounting holes in support members 206. End caps 202 and 204 may be spot welded, screwed, glued, or mechanically attached to component section 208 and 212. Component sections 208, 210, and 212 may be spot welded, screwed, glued, or mechanically attached to each other. Component sections 208, 210, and 212 may be formed as one material sheet such as a single piece of sheet metal or may be pieced together as shown in FIG. 2. Likewise, end caps 202 and 204 may be formed as a single integrally formed batting bin with component sections 208, 210, 212, and support members 206. A length of batting bin 200 may be ranging from 5 feet to 15 feet from end cap 202 to end cap 204. A width of batting bin 200 may be ranging from 6 inches to 18 inches measured from front side 228 to rear side 230. A height of batting bin trough local minima to the trough local maxima may range from 4 inches to 18 inches. This height may also be determined by a depth of the trough or a depth of water able to be held within the trough. The purpose of batting bin 200 is to keep batting material off of the floor and in a position easily useable by quilting machine 100.

Figure 3:
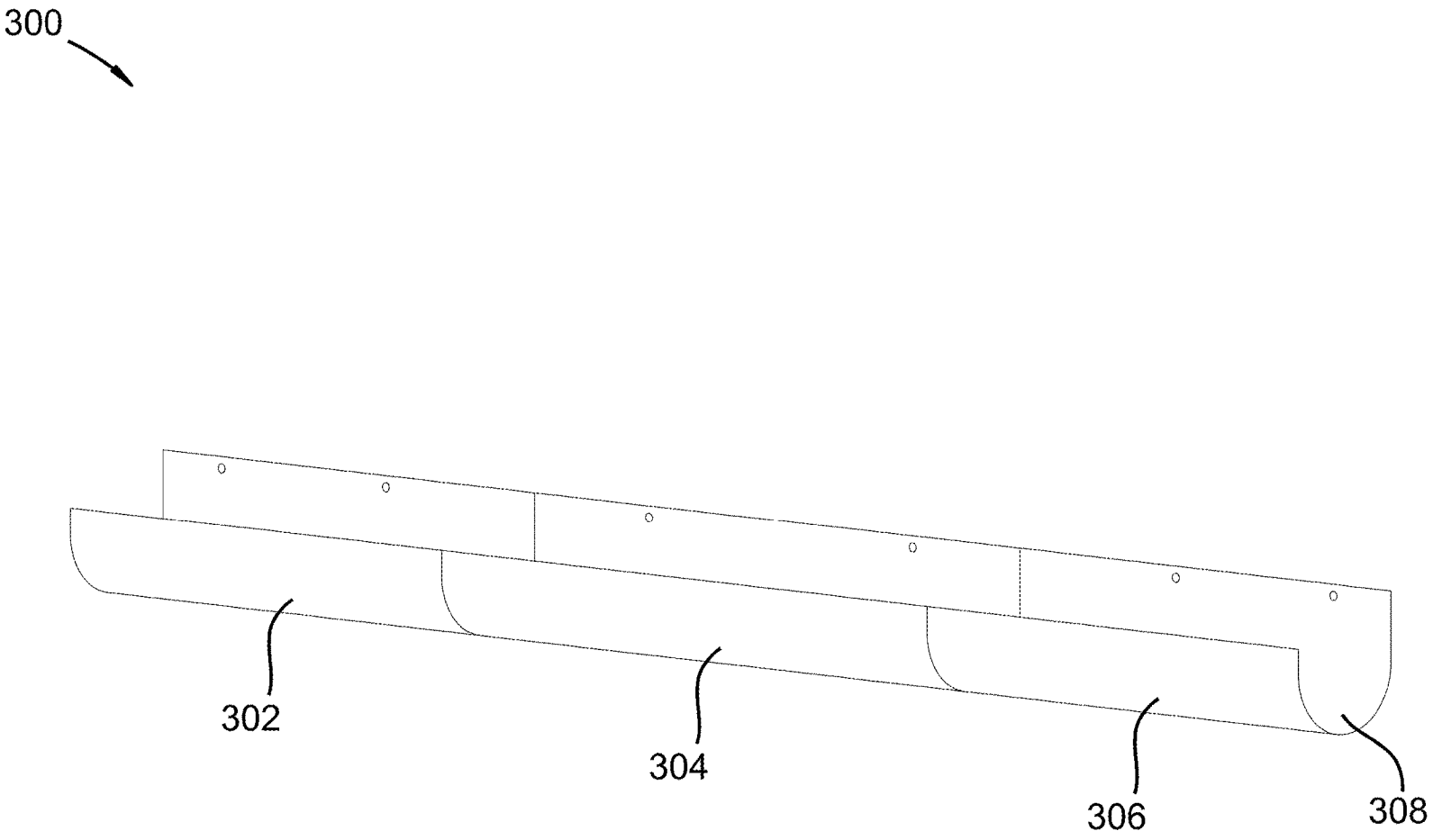
FIG. 3 depicts a batting bin trough in accordance with an embodiment of the invention.

FIG. 3 shows a batting bin trough 300 in accordance with an embodiment of the invention. Through 300 includes sections 302, 304, and 306. Trough bottom 308 may be any shape. In Figure, trough bottom 308 is shown as a semi-circle, but may be rectangular or square. Trough 300 is designed to be generally smooth on the inner surface allowing batting material to have snag free clean environment. Trough 300 may be formed from sheet metal, fiber glass, wire, wire mesh, plastic, screen material, perforated material, composite materials, wood, paper, or a combination thereof.

Figure 4:
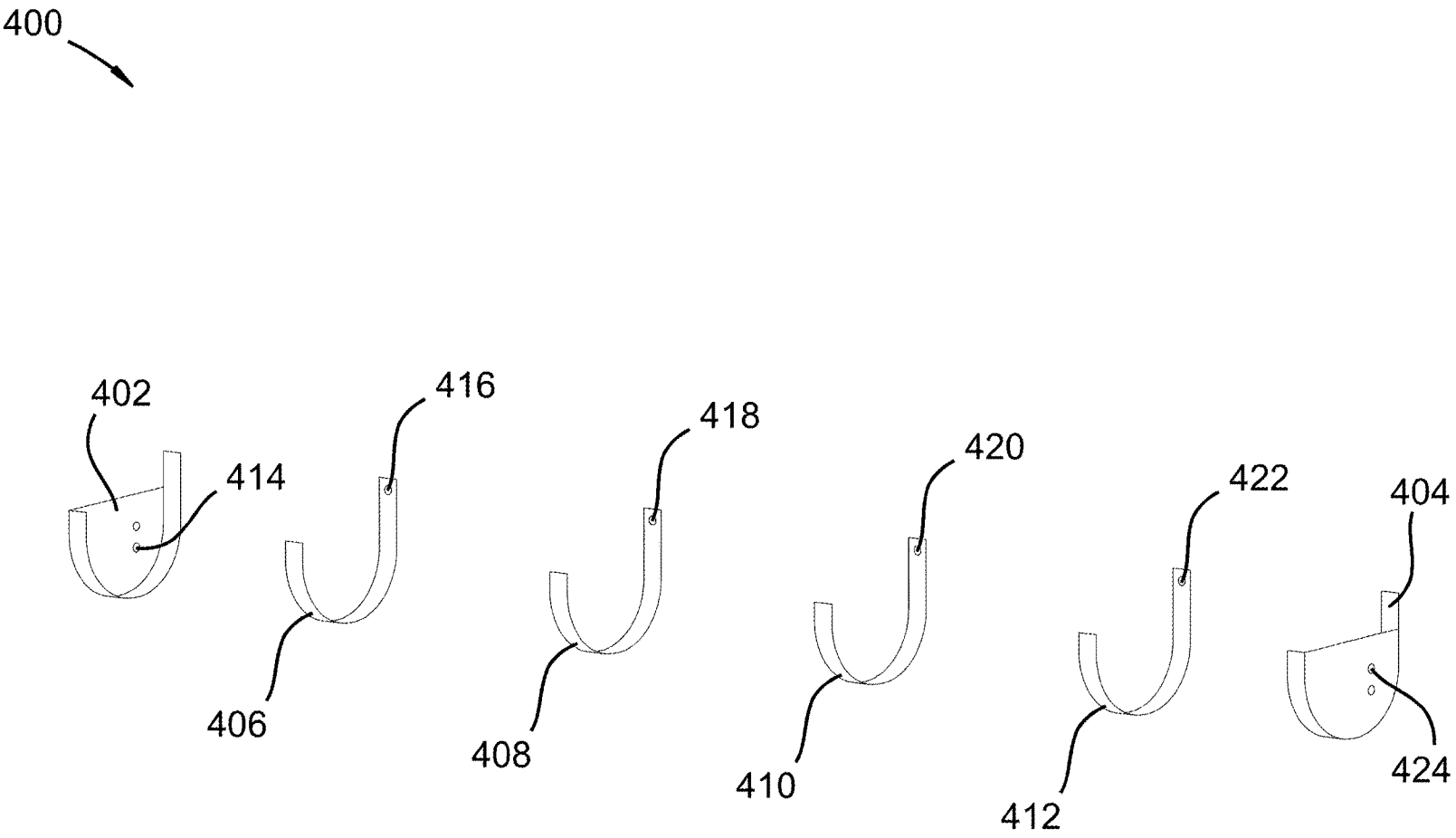
FIG. 4 depicts end caps and support members in accordance with an embodiment of the invention.

FIG. 4 shows end caps and support members 400 in accordance with an embodiment of the invention. End caps 402 and 404 may be each formed as a single component as shown in FIG. 4 or may be part of a larger single formed batting bin mold. Support members 406-412 may be each formed as a single component as shown in FIG. 4 or may be part of a larger single formed batting bin mold. End caps 402 and 404 may each have one or more mounting holes allowing batting bin 200 to be connected to quilting machine 100. Support members 416-422 may each have one or more mounting holes allowing batting bin 200 to be connected to quilting machine 100. Support member holes 416-422 may be conjoining holes with trough holes 216-226 allowing the support members and the trough to be firmly connected to quilting machine 100.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A long arm quilting machine comprising:

a batting bin, the batting bin comprising:

an elongated partially enclosed trough attached to the quilting machine and extending, in length, more than 50% of a longest dimension of the quilting machine;

the batting bin having one or more support members to support a position of the trough in relation to the quilting machine;

the trough having an open upper portion which allows batting material to be dispensed upward between two sheets of material attached to a first material roller and a second material roller of the quilting machine;

the trough having an enclosed lower portion such that batting material within the trough is kept from touching a floor the quilting machine is positioned over; and the trough further comprising end caps which enclose the lower portion of the trough.

2. The quilting machine of claim 1, wherein the batting bin has two or more support members.

3. The quilting machine of claim 1, wherein the batting bin is formed from sheet metal, fiber glass, wire, wire mesh, plastic, screen material, perforated material, wood, paper, or a combination thereof.

4. The quilting machine of claim 1, wherein the trough has a length of between 5 feet and 15 feet.

5. The quilting machine of claim 1, wherein the trough has a width of between 6 inches and 18 inches.

6. The quilting machine of claim 1, wherein the trough has a height of between 4 inches and 18 inches.

7. The quilting machine of claim 1, wherein the batting bin attaches to the quilting machine using screws, hinges, bolts, hooks, glue, welds, or a combination thereof.

8. The quilting machine of claim 1, wherein a front side of the batting bin is lower than a rear side of the batting bin forming an angled trough.

9. The quilting machine of claim 1, wherein the lower portion of the trough is semi-circular.

10. The quilting machine of claim 1, wherein the lower portion of the trough is rectangular or square in shape.

11. The quilting machine of claim 1, wherein the end caps provide structural support for the batting bin by attaching to the quilting machine.

12. The quilting machine of claim 8, further comprising two or more through holes in the rear side of the batting bin for attaching the batting bin to the quilting machine.

13. The quilting machine of claim 8, wherein the angled trough allows a user to easily access the quilting machine and the batting material during operation of the quilting machine.

14. The quilting machine of claim 1, further comprising an automated sewing function.

15. The quilting machine of claim 14, wherein the automated sewing function sews the batting material between the two sheets of material.

16. The quilting machine of claim 15, wherein the batting bin keeps debris off of the batting material while the batting material is sewn between the two sheets of material.

* * * * *